US009433298B2

(12) United States Patent
Bryer

(10) Patent No.: US 9,433,298 B2
(45) Date of Patent: Sep. 6, 2016

(54) ERGONOMIC SEAT ASSEMBLY

(76) Inventor: Matthew D. Bryer, Gibsonia, PA (US)

( * ) Notice: Subject to any disclaimer, the term of this patent is extended or adjusted under 35 U.S.C. 154(b) by 831 days.

(21) Appl. No.: 13/373,973

(22) Filed: Dec. 8, 2011

(65) Prior Publication Data

US 2012/0098310 A1 Apr. 26, 2012

Related U.S. Application Data

(63) Continuation-in-part of application No. 12/387,854, filed on Jun. 8, 2009, now abandoned.

(51) Int. Cl.
*A47C 7/02* (2006.01)
*A47C 7/42* (2006.01)

(52) U.S. Cl.
CPC ..... *A47C 7/022* (2013.01); *A47C 7/021* (2013.01); *A47C 7/425* (2013.01)

(58) Field of Classification Search
CPC ..... A47C 7/022; A47C 7/021; A47C 7/425
USPC ..... 297/284.5, 219.1, 219.12, 452.3, 297/452.26
See application file for complete search history.

(56) References Cited

U.S. PATENT DOCUMENTS 3,145,054 A * 8/1964 Sopko, Jr. ..... 297/452.3
5,056,533 A * 10/1991 Solano ..... 5/653 X
5,702,153 A * 12/1997 Pliska ..... 5/653 X

* cited by examiner

*Primary Examiner* — Anthony D Barfield
(74) *Attorney, Agent, or Firm* — Paul Bogdon

(57) ABSTRACT

An ergonomical seat assembly for supporting a seated human body in correct posture to maintain proper and healthy spine, hip, and pelvic alignment. The seat assembly includes a back panel for supporting the back of a user in an upright sitting position and side support members for engaging the sides of the user's torso. Included is a lumbar support member for engaging the lower back of the user just above the hips. The back panel is secured to a base panel upon which is arranged hip support members for engaging the seated user's hips. Together the elements of the seat assembly maintain proper and healthy posture of a seated user and comfortable long or short term seating.

14 Claims, 7 Drawing Sheets

*Before*

LEGS SPLAYED OUT
HIPS NOT STRAIGHT

*Before*

SHOULDERS SLUMPED
FORWARD
SPINE STRAIGHT

*After*

LEGS TOGETHER
HIPS SUPPORTED AND
BODY PERFECTLY ALIGNED

*After*

SHOULDERS BACK
SPINE PROPERLY CURVED

ERGONOMIC SEAT ASSEMBLY

RELATIONSHIP TO OTHER PATENT APPLICATIONS

This patent application is a Continuation-In-Part Application of U.S. patent application Ser. No. 12/387,854 filed Jun. 8, 2009 now abandoned in the name of Matthew D. Bryer for ERGONIMIC SEAT ASSEMBLY.

BACKGROUND OF THE INVENTION

1. Field of Invention

This invention relates to an ergonomic seat assembly for supporting a human body in correct posture to maintain proper and healthy spine alignment.

2. Description of Prior Art

Cushioned ergonomic seat assemblies are desirable for increasing the comfort-level of the user and at the same time preventing ligament, joint and hip problems. Normal sitting is more often than not in an improper, unhealthy posture which may result in back pain and other physical ailments and infirmities. Too often a human person in a seated position is not properly supported resulting in the toeing out and splaying of the legs which causes the hips to rotate outwardly. The unhealthy positioning of the legs and hips in the user could result in ligament weakness, plastic deformation of joint tissue and lead to chronic occurrence of conditions such as hip bursitis and accelerated degeneration. In addition to the unhealthy positioning of the user's legs and hips, the spine is improperly aligned because of the tendency of the user to slump or slouch with the spine generally unnaturally straight when the spine should be naturally curved. The slumping or slouching of the user causes lower back pain because of the loss of the natural and healthy lumbar curve.

A number of attempts have been tried for preventing the problems resulting from unhealthy posture of persons when sitting. Certain of the attempts have been directed to the posture problems of wheelchair users and particularly paraplegics. U.S. Pat. No. 5,211,446 is directed to a wheelchair back system concerned with the problems associated with long term wheelchair users, such problems including kyphosis, scoliosis, instability, redness of the spine, and pain of the back. The system of U.S. Pat. No. 5,211,446 did not consider the tendency of a person sitting to misalign hips, pelvis and spine, by the unhealthy toeing out and splaying of the sitter's legs. There was no suggestion in U.S. Pat. No. 5,211,446 that toeing out and splaying of the legs was a problem in need of correction. Also, the back system of U.S. Pat. No. 5,211,446 was geared specifically to use with wheelchairs, and was somewhat complicated in structure and not readily adaptable for ordinary use by a sitting person.

U.S. Pat. No. 6,929,325 is directed to a cushion for relieving pressure on the tailbone (coccyx) and on the ischeal turberosities (seat bone) for promoting proper positioning of the sacroiliac joint and for supporting the lower back of the user. No structure was suggested for avoiding splaying of the legs of the user or for preventing lateral translation of the user's torso U.S. Pat. No. 5,018,790 is directed to a customized seat cushion for correcting the posture of a wheelchair user. There is no disclosure or suggestion in U.S. Pat. No. 5,018,790 of structure to emplace a user's spine in a normalized, healthy lumbar lordosis, or to secure the user's torso against lateral translation, which are needed for proper, healthy spine alignment.

Other support cushions have been suggested but are not constructed for providing proper, healthy posture for a user when sitting. U.S. Pat. No. 5,056,533 of Toni Solano is directed to a cushion for providing added support and comfort to the user (Col. 1, lines 49-50) and " . . . should the user be disabled the cushion can be used to conveniently transport him with minimum discomfort (Col. 1, liner 51-53); and to provide . . . an improved means for comfortably transporting individuals who are confined to beds and wheelchairs" (Col. 1, lines 57-58). There is no indication or suggestion throughout Solano that his cushion provides structure for supporting a seated human body in correct position to maintain proper and healthy spine, hip, and pelvis alignment or preventing toeing out and splaying of a user's legs.

Various other seat structures have been attempted with the focus on providing proper back support or on seat comfort without recognizing the need for simultaneous support and alignment of the spine, hips, and pelvis of the sitting person. U.S. Pat. Nos. 3,542,421 and 3,279,849 are directed to back supports only while U.S. Pat. No. 5,687,436 is for seat cushion only for use with a wheelchair. None of these patents disclosed or suggested seat structures for complete, proper, and healthy hip, pelvis, and spine alignment and support.

The present invention overcomes the problems inherent in the existing known structures of seat and back support cushions and systems, by providing an ergonomic seat assembly for supporting the human body in proper and healthy spine, hip, and pelvic alignment. The complete structure of the seat assembly of this invention prevents the toeing out or splaying of the legs of the user while simultaneously securing the torso of the user against lateral translation, and normalizes proper curvature of the lumbar lordosis. Proper alignment of the user's hips, pelvis, and spine is secured and maintained, thereby avoiding the pain, ligament weakness, deformation of joint tissue, hip bursitis, and accelerated degeneration, all of which are common problems resulting from improper, unhealthy overall sitting posture. The positive healthy results achieved by this invention are by an ergonomic seat assembly which is simple in construction, adjustable to fit most sitting users, portable, capable of relatively low cost manufacture, and affordable to the consumer.

SUMMARY OF THE INVENTION

The present invention provides an ergonomic seat assembly for supporting a human body in a sitting position in a correct posture to maintain proper and healthy spine, hip, and pelvis alignment. The seat assembly includes a generally flat back panel sized and shaped for supporting the back of a user in an upright sitting position. A pair of elongated side support members are disposed on the back panel. One each of the side support members is selectively attachable and laterally and upwardly and downwardly movably disposed on opposite lateral side sections of the back panel, with each of the side support members sized and shaped to fit under the arms of the user for engaging the side of the side torso at the rib section of the user in a seated position. A generally flat base panel is pivotally secured at its inner end section to a lower end section of the back panel member for supporting a user in a seated position. An elongated lumbar support member is selectively attached and upwardly and downwardly moveably disposed at a lower portion of the back panel, and is sized and shaped for snugly engaging a lower back portion of a user in a seated position and contoured to conform to the natural curvature of the spine of the user. A pair of elongated hip support members are disposed on the base panel. One each of the hip support members are selectively attachable and laterally, forwardly and rearwardly movably disposed on opposite lateral side sections of the base panel, with each of the hip support members being sized, shaped, and sloped for snugly engaging the hip area of a user in a seated position for relieving pressure on the spine of the user. The back panel, side support members, the lumbar support member, the base panel, and the hip support member, are sized, shaped, constructed and arranged such that when a user is seated on the base panel with the user's back against the back panel and the side support members are in engagement with the sides of the user's torso and under the arms of the user, and the lumbar support member in engagement with the user's lower back (lumbar region), and contoured to conform to the natural curvature of the spine of the user and the hip support members in engagement with the user's hips and relieving the pressure on the spine of the user from the weight of the user's torso, proper and healthy spinal alignment is maintained, toeing out and splaying of the legs prevented, outward rotation of the hips avoided, keeping the user's body in proper alignment to effect correct and healthy posture. The side and back panels may be arranged such that the panels may be selectively pivoted with respect to each other to and from a generally parallel relation to each other. Means may be provided for pivoting the back panel to a generally right angle relation to the base panel. There may also be provided straps or the like to secure the back panel to the base panel when the panels are in a generally parallel relation to each other. The straps or the like may also be arranged to serve as a handle for use in carrying the seat assembly. The seat may be provided with an opening generally centrally disposed at the inner end of the panel for receiving the tailbone portion of the user's lower back. The back panel may also be provided with a brace or the like to secure the back panel in an upright position allowing the seat assembly to be used independently of a chair, bed and the like. This seat assembly may also be modified in various other ways, by use of different material for different resiliency of the panels and support members, or by different curvatures of the back and base panels, or by attaching different support members to provide support needs of different users. The seat assembly may be fixed onto a chair, or like, or on a vehicular seat (e.g. automobile seat).

It is to be noted that the combination of the elements comprising the ergonomic seat assembly of this invention results in any user realizing correct, healthy posture, support, and comfort while seated. Toeing out and splaying of the user's legs are prevented where otherwise the user's hips would rotate, avoiding and preventing ligament weakness and elastic deformation of joint tissue thereby preventing chronic occurrence of conditions such as hip bursitis and accelerated degeneration. The side supports on the back panel provide lateral and vertical support aiding in the reduction of lateral translation of the user's torso. The lumbar support assures proper curvature to the user's spine when the user's back is against the back panel. The hip supports align the user's hips to maintain proper alignment of the hips, pelvis, and spine. The user's body is placed in virtually perfect alignment and support, avoiding the aforementioned problems resulting from unhealthy improper posture as noted hereinbefore.

Various other advantages, details, and modifications of the seat assembly of the present invention will become apparent and indicated as the following description of a certain preferred embodiment and modification thereof proceeds.

BRIEF DESCRIPTION OF THE DRAWINGS

In the accompanying drawings I show certain present preferred embodiments my present invention in which.

DESCRIPTION OF PREFERRED EMBODIMENTS

Figure 9:
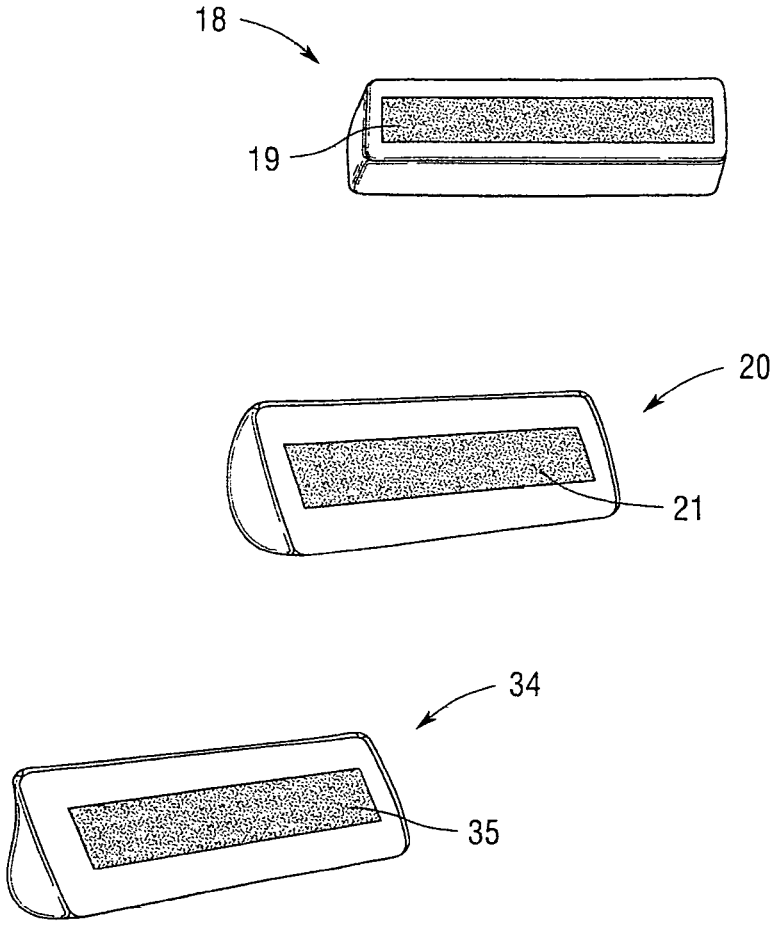
FIG. 9 is perspective views of a side support member, lumbar support member, and a hip support member showing the backs thereof with adhering strips thereon.

Referring now to the drawings there is shown an ergonomical seat assembly 10 for supporting a seated human body (user) in correct posture to maintain proper and healthy spine, hip, and pelvis alignment. The seat assembly 10 includes a back panel 12 for supporting the back of a user in an upright sitting position. The back panel 12 is preferably of a somewhat firm, but lightweight material such as any suitable urethane of a various density. The back panel 12 may be covered with a non-slip fabric. The back panel 12 is to be wide and long enough to support the back of a user. A width of around 20 inches and a length of around 16 inches would be suitable to support an average sized user. Larger or smaller sizes of this back panel 12 could be used. For reference purposes, as shown the back panel 12 has an upper section 14 and a lower section 16 with any description of movement upwardly or downwardly would be towards or away from the upper section 14 and the lateral sides of the back panel 12 would be between the upper section 14 and lower section 16. Disposed on the back panel 12 is a pair of elongated identically shaped side support member 18, one each selectively attachable and laterally and upwardly and downwardly movably arranged on opposite side sections of the back panel 12. Each side support member 18 is sized and shaped to fit under the arm of the user in a seated position with the back of the user against the back panel 12 and for engaging the side of the torso at the rib section of the user. As shown in FIG. 9 each side support member 18 has secured to its underside a strip of an adhesive material 19 such as Velcro allowing the side support members 18 to be suitably secured to the back member 18 and selectively moved by removing them from the back panel 12 and positioning them as desired. As with back panel 12 the side support member 18 could be formed of the same material forming the back member 12 and covered with a suitable fabric. The length of each side support 18 should such to extend from near the user's armpit to the lower section of the user's torso. Also arranged on the back panel 12 is a selectively attachable elongated lumbar support member 20 with its longitudinal axis generally parallel to the upper section 14 and lower section 16 of the back panel 12. The lumbar support member 20 is shaped and sized to snugly engage the lower back portion of the user in a seated position and is contoured to conform to the natural curvature of the spine of the user. The lumbar support member 20 constructed of the same material as that of the back panel 12 and side support member 18 and covered with a suitable fabric, is secured to the back panel 12 by a Velcro adhesive strip 21 as shown in FIG. 9. The lumbar support 20 is selectively removable upwardly and downwardly for emplacement just above the user's hips. The side support member 18 would be oriented to custom fit a user by engaging the sides of the user's torso for providing lateral and vertical support to the user as well as reducing lateral translation of the user's torso.

Figure 1:
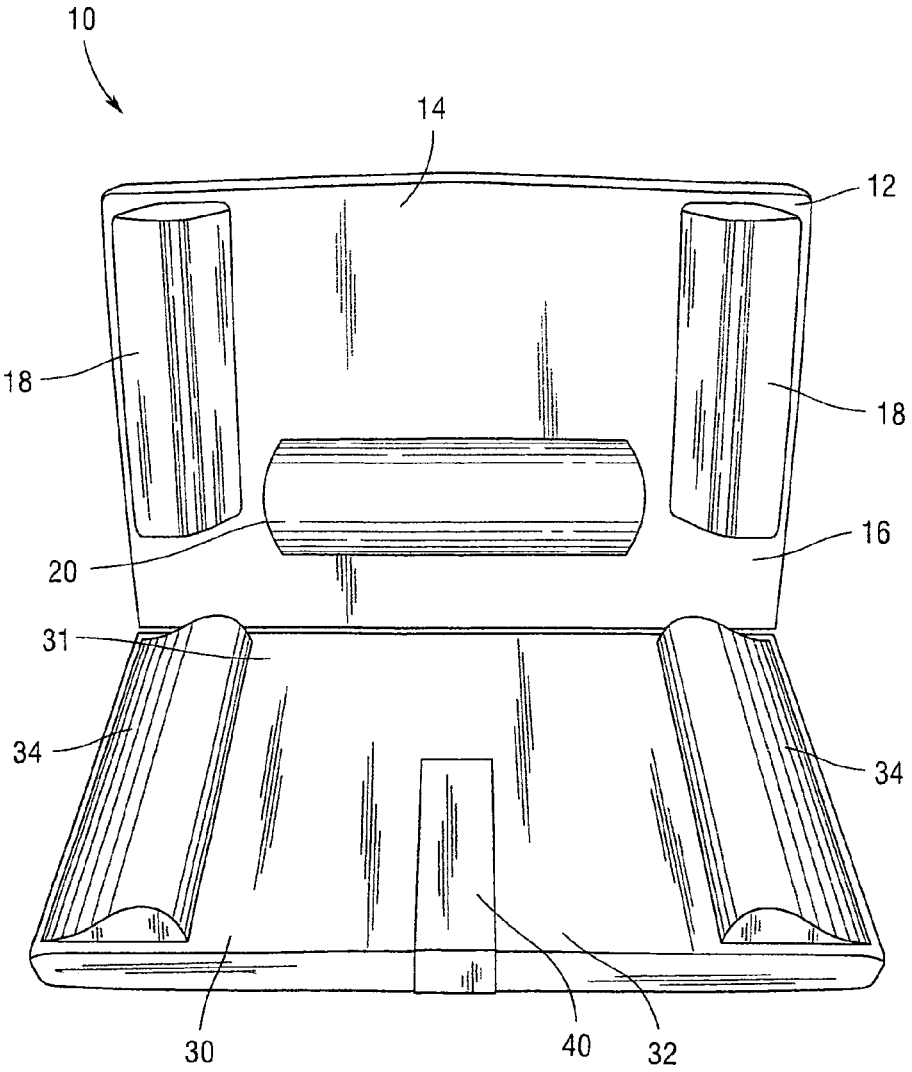
FIG. 1 is a perspective view of the ergonomical seat assembly of the present invention with the elements oriented for a person to assume a seated position on it.
Figure 2:
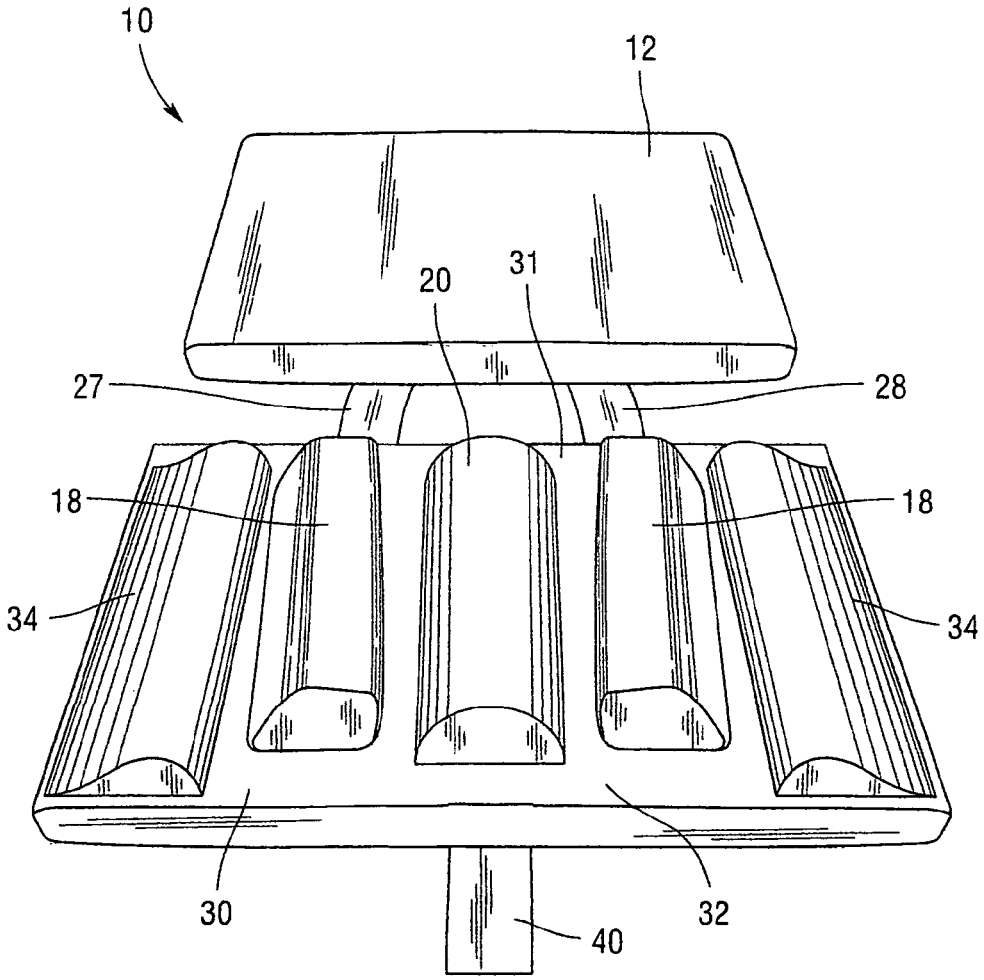
FIG. 2 is a perspective view of the seat assembly of FIG. 1 showing the back panel out of engagement with the seat panel and the side support members and lumbar support members arranged on the seat panel.

The back panel 12 is selectively pivotably or rotatably secured to a base panel 30 sized and shaped similarly to the back panel 12. Any suitably means may be used to secure the back panel 12 to the base panel 30 such as straps 27 and 28 and as shown in FIG. 2. The straps 27 and 28 may be secured to both the back panel 12 and seat panel 30 by Velcro adhesive strips, not shown. As also shown in FIG. 2 the side support members 18 and lumbar support member 20 may be removed from the back panel 12 and secured on the seat panel 30 when storing or transporting the seat assembly 10 as will be more fully described hereinafter. The seat panel 30 would preferably be constructed of the same material as the back panel 12 and would be interchangeable with the back panel 12. For reference purposes, as shown the base panel 30 has an inner end section 31 and an outer end section 32 with reference to forward or rearward movement would be toward or away from the inner end section 31, and the lateral sides of the base panel 30 are between the inner end section 31 and outer end section 32. Disposed on the base panel 30 is a pair of elongated identically shaped hip support members 34, one each selectively attachable and laterally and forwardly and rearwardly movably arranged on opposite side sections of the base panel 30. As shown, the side sections of the hip support members 34 have different slopes or angles, one slope or angle greater than the other slope or angle, allowing support at different levels, that is, supporting the different shaped hips of different users. In other words each hip support member 34 is sized, shaped and sloped for engaging hip areas of the user for relieving pressure on the spine of the user from the weight of the user's torso. Although the hip supports 34 are shown with different side slopes or angles, the hip supports 34 could have sides of the same slopes or angles. As shown in FIG. 9 each hip support member 34 has secured to its underside a strip of Velcro adhesive material allowing the hip support members 34 to be suitably secured to the base panel 30 and selectively moved or rotated 180 degrees by removing them from the base panel 30 and positioning them as desired for accommodating different users of different shaped hips. With a user seated on the base panel 30 the hip support members 30 would be positioned to snugly engage the user's hips to maintain proper alignment of the user's hips, pelvis, and spine as well as relieving the pressure on the spine from the weight of the user's torso. As shown in FIG. 1, the inner ends of the hip support members 30 are located at the inner end section 31 of the base member 30 and as so located the hip support members 30, or either of them, would serve to limit the movement of the back panel 12 to an upright position relative to the base member 30.

Figure 6:
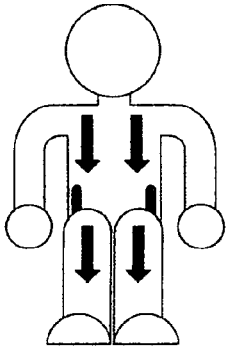
Figure 7:
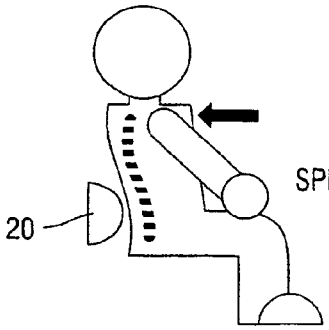

With the seat assembly 10 emplaced on a backed chair, for example, a user would sit on the seat assembly with the user seated on base member 30 with the user's upper back against the surface of the back panel 12. The contoured lumbar support 20 would be positioned just above the user's hips as shown in FIG. 7, conforming to the natural curvature of the user's spine. The side support members 18, as previously described, would be emplaced snugly against the sides of the user's torso and under the user's arms and the hip support 34 emplaced snugly against the user's hip areas to relieve the pressure on the spine of the user from the weight of the user's torso. As represented in FIGS. 6 and 7 the combination of the side support member 18 and the lumbar support 20 locks in the user to a proper seated position. As graphically illustrated in FIG. 7 the user's shoulders are back and the spine would be in proper curvature by normalizing the lumbar lordosis. As represented in FIG. 6, and earlier described, the hip support members 34 allow the user to maintain proper alignment of the hips, pelvis, and spine. With the side support member 18, lumbar support member 20, and hip support member 34 on the body of a user in a seated position on the base panel 30 and against the back panel 12, a healthy spinal alignment is maintained, toeing out and splaying of the user's legs prevented, outward rotation of the user's hips avoided, and overall keeping the user's body in proper alignment to effect correct and healthy posture.

Figure 4:
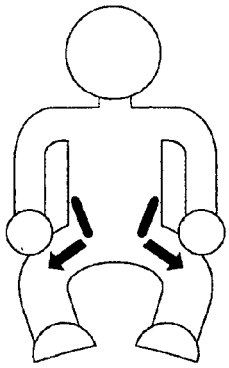
FIG. 4-7 are imitations of a person in a seated position with an improper, unhealthy misaligned spine, hips and pelvis, and in a seated position in proper, healthy, posture with proper, healthy aligned spine, hip, and pelvis, resulting from use of the seat assembly of my present invention.
Figure 5:
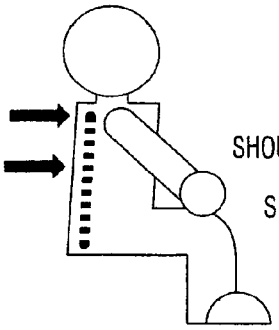

As graphically illustrated in FIGS. 4 and 5 usual sitting of any human person is in an improper and unhealthy posture. The person's legs are toed out and splayed and the hips are not straight. This person's shoulders are usually slumped forward and spine straight. Using the ergonomical seat assembly 10 of my invention, in a seated position on the seat assembly 10 the user's legs are together, the hips are supported resulting in perfect alignment of the body, and the user's shoulders are back with the spine properly curved. With the use of the seat assembly 10 the user's seated body is in proper alignment effecting correct and healthy posture. The user is accordingly comfortably seated for long or short term with serious physical problems avoided such as ligament weakness, plastic deformation of joint tissue, and chronic occurrence of conditions such as hip bursitis and accelerated degeneration. Where a potential user has specific bodily problems a chiropractor might position the supports to effect support and promote long term correction of problems such as spinal/postural distortions like pelvic unleveling and curvature of the spine.

Figure 8:
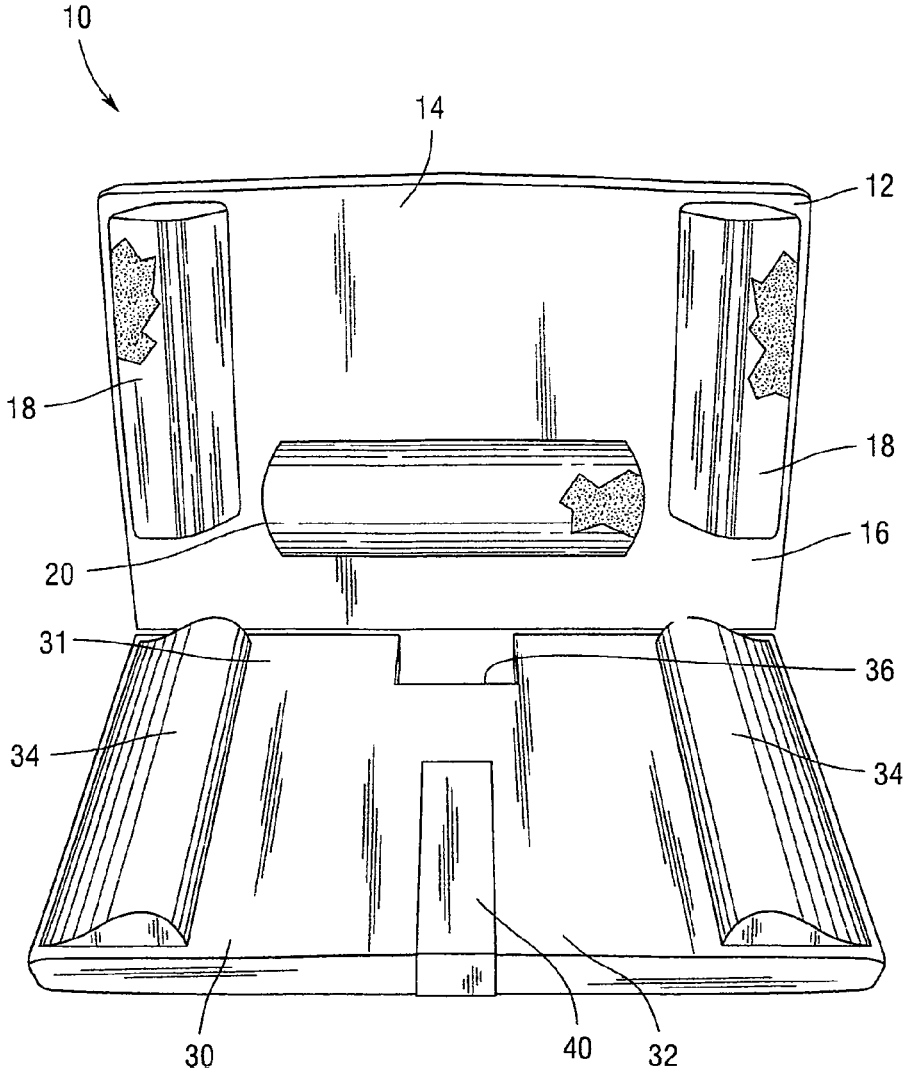
FIG. 8 is a perspective view of the seat assembly of my present invention showing the seat panel with a cutout at the inner end portion thereof for receiving the tailbone section of the lower back of a user.

As shown in FIG. 8, the seat assembly 10 of my present invention is provided with a base member 30 defining a cutout 36 for receiving the tailbone section of a user's lower back for relieving the pressure on the user's tailbone.

Figure 3:
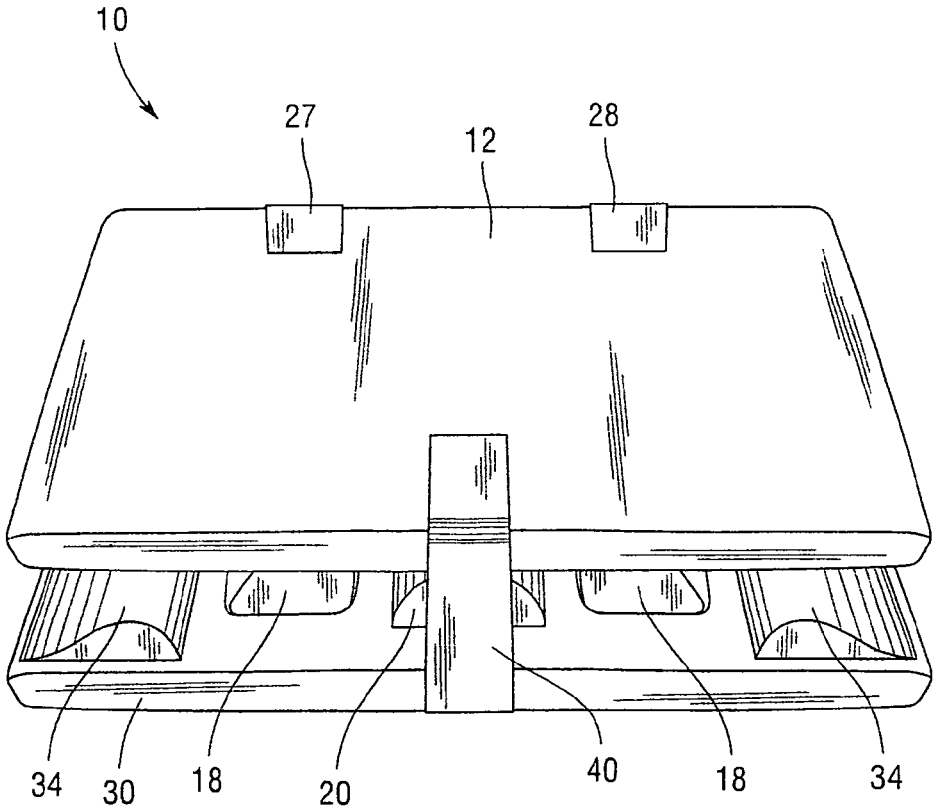
FIG. 3 is a perspective view of the seat assembly of FIG. 1 with the back panel folded into a generally parallel orientation with respect to the seat panel and the panels secured to each other and ready for being carried as a unit.

As shown in FIG. 2, the side support members 18 as previously described, and lumbar support 20 may be removed from the back panel 12 and secured to the upper surface of the back base panel 30. The back panel 12 could be lifted up and rotated to a position generally parallel to the base panel 30 as shown in FIG. 3 and secured to the base panel 30 by strap 40 and the entire seat assembly 10 easily carried for storage or use in some other place.

Figure 10:
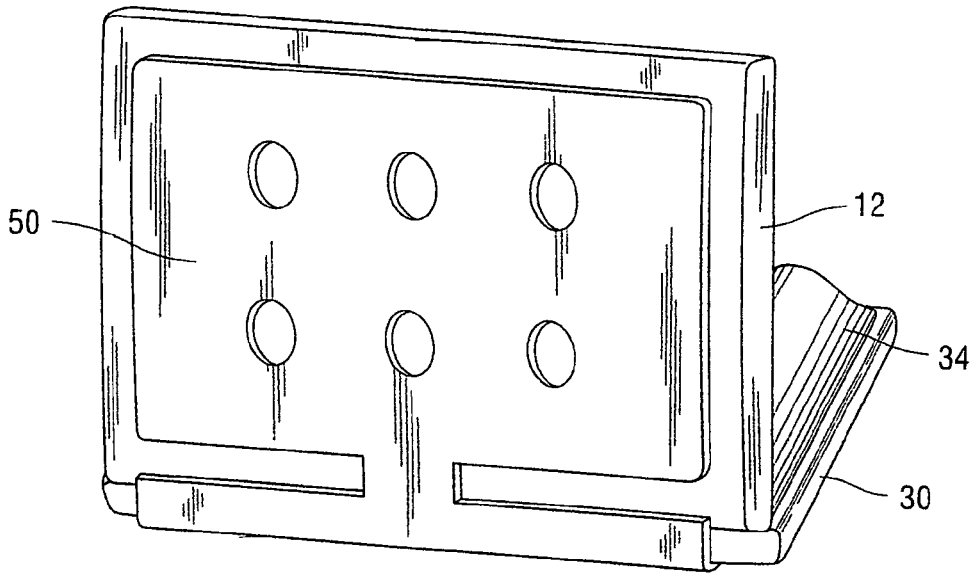
FIG. 10 is a perspective view of another embodiment of the seat assembly of my present invention showing the back panel bracketed and secured in an upright position.

FIG. 10 shows another embodiment of the seat assembly 10 of my present invention which includes a rigid bracket 50 arranged on the backside of the back panel 12 and interconnected with a base panel 30 to fix and secure the back panel 12 in an upright position allowing the seat assembly 10 to be used independently of a stiff-backed chair or the like.

It should now be clearly apparent as how the ergonomical seat assembly 10 of my present invention results in correct, proper, and healthy posture of a user avoiding and preventing physical bodily problems associated with improper, unhealthy sitting posture. In addition to the significant health results from use of my seat assembly 10, the seat assembly is simply and relatively inexpensive to produce, very simple to use, easily transportable, and attractive in overall appearance. The seat assembly of this invention may have its elements shaped and constructed for accommodating users of different body shapes; that is, my seat assembly may be customized and adjusted in its elements for most differing bodily shaped users. The elements of my seat assembly may also be shaped and constructed for accommodating users having abnormal bodily shapes such as misaligned hips, scoliosis, injured body parts, and the like. Various other modifications and advantages of the seat assembly of my invention should be clearly understood by those skilled in the art.

While I have described certain present preferred embodiments of my invention it is to be distinctly understood that the invention is not limited thereto but may be otherwise embodied within the scope of the following claims.

I claim:

1. An ergonomical seat assembly for supporting a seated human body in correct posture to maintain proper and healthy spine, hip and pelvis alignment, comprising:

back panel means for supporting the back of a human person in an upright sitting position;

side support means attached with said back panel means, said side support means sized and shaped to fit under the arms of the human person in a seated position with the back of the person against the back panel means and for engaging the side of the torso at the rib section of the human person in a seated position;

the said side support means including a pair of elongated side support members, one each selectively attachable and laterally, and upwardly, and downwardly moveably disposed on opposite lateral side sections of said back panel means, each of said side support members sized and shaped for engaging the side of the torso of a human person in a seated position;

lumbar support means attached with said back panel means and shaped and sized for snugly engaging the lower back portion of a human person in a seated position, and contoured to conform to the natural curvature of the spine of the human person;

base panel means secured to said back panel means for supporting a human person in a seated position;

hip support means attached with said base panel means and sized, shaped, and sloped for engaging hip areas of a human person for relieving pressure on the spine of the human person from the weight of the human person's torso;

said back panel means, side support means, lumbar support means, base panel means, and hip support means constructed and arranged such that when a human person is seated on said base panel means with the person's back against said back panel means, and said side support means are in engagement with the sides of the person's torso and under the arms of the person, and said lumbar support means in engagement with the person's lower back and contoured to conform to the natural curvature of the spine of the person, and said hip support means in engagement with the person's hips and relieving the pressure on the spine of the person from the weight of the person's torso, and healthy spinal alignment is maintained, toeing out and splaying of legs prevented, outward rotation of the hips avoided, keeping the person's body in proper alignment to effect correct and healthy posture.

2. The ergonomical seat assembly as set forth in claim 1 wherein said base panel means is pivotably secured at its inner end section to a lower end section of said back panel means.

3. The ergonomical seat assembly as set forth in claim 1 wherein said hip support means includes a pair of elongated hip support members, one each selectively attachable and laterally, forwardly and rearwardly movably disposed on opposite lateral side sections of said base panel means, each of said hip support members sized and shaped for snugly engaging the hip area of a person in a seated position.

4. The ergonomical seat assembly as set forth in claim 3 wherein at least one of said hip support members has side sections of different slopes or angles sized and shaped for snugly engaging different shaped hip areas of different persons, each person in a seated position.

5. The ergonomical seat assembly as set forth in claim 3 wherein at least one of said hip support members having its inner end disposed at the inner end of said base panel means for limiting the movement of said back panel means to a generally right angle position relative the position of said base panel means.

6. The ergonomical seat assembly as set forth in claim 1 wherein said hip support means is disposed on said base panel means in a position for limiting the movement of said back panel means to a generally right angle position relative to the position of said base panel means.

7. The ergonomical seat assembly as set forth in claim 1 wherein said back panel means is sized and shaped and selectively rotatable to a generally parallel position relative to said base panel means with said hip support means attached to said base panel means.

8. The ergonomical seat assembly as set forth in claim 7 including holding means for securing said back panel means to said base panel means when they are in a generally parallel position to each other.

9. The ergonomical seat assembly as set forth in claim 1 wherein said base panel means defines an opening generally centrally disposed at the inner end position thereof for receiving the tailbone portion of the person's lower back.

10. An ergonomically adjustable seat assembly for supporting a human body in correct posture to maintain proper and healthy spinal alignment, comprising:

back panel means for supporting the back of a human person in an upright position;

a pair of elongated side support members, one each selectively attachable and laterally, and upwardly and downwardly movably disposed on opposite lateral side sections of said back panel means, each of said side support members sized and shaped to fit under the arms of the human person in a seated position and for engaging the side of the torso of a human person in a seated position at the rib section of the human person in a seated position;

base panel means pivotably secured at its inner end section to a lower end section of said back panel means for supporting a human person in a seated position;

an elongated lumbar support member selectively attachable and upwardly and downwardly movably disposed at a lower portion of said back panel means sized, shaped and contoured for snugly engaging a lower back portion of a human person in a seated position, said contoured shape to conform to the natural curvature of the spine of the human person;

a pair of elongated hip support members, one each selectively attachable and laterally, forwardly and rearwardly movably disposed on opposite lateral side sections of said base panel means, each of said hip support members sized and shaped and sloped for snugly engaging the hip area of a human person in a seated position and for relieving pressure on the spine of the person from the weight of the person's torso;

at least one of said hip support members having its inner end disposed at the inner end of said bare panel means for limiting the movement of said back panel means to a generally right angle position relative to the position of said base panel means; and said back panel means is sized, shaped and secured to said base panel means and is arranged for selective rotation to a generally parallel position relative to said base panel means with said hip support member attached to said base panel means and said side support members removed from said back panel means;

said back panel means, side support members, said lumbar support member, said base panel means, and hip support means sized, shaped, constructed and arranged such that when a human person is seated on said base panel means with the person's back against said back panel means and said side support members are in engagement with the sides of the person's torso, and under the arms of the person, and said lumbar support member in engagement with the person's lower back and conforming to the natural curvature of the spine of the person and said hip support members in engagement with the person's hips for relieving the pressure on the spine of the person from the weight of the person's torso, proper and healthy spinal alignment is maintained, toeing out and splaying of legs prevented, outward rotation of the hips avoided, keeping the person's body in proper alignment to effect correct and healthy posture.

11. The ergonomically adjustable seat assembly as set forth in claim 10 including holding means for securing said back panel means to said base panel means when they are in a generally parallel position to each other.

12. The ergonomically adjustable seat assembly as set forth in claim 10 whereby said side support members are removably secured on said base panel means.

13. The ergonomically adjustable seat assembly as set forth in claim 10 wherein said base panel means defines an opening generally centrally disposed at the inner end position thereof for receiving the tailbone portion of the person's lower back.

14. The ergonomically adjustable seat assembly as set forth in claim 10 including bracing means secured to both rear back panel means and base panel means for securing said back panel means in an upright position relative to said base panel means.

* * * * *